US007204256B2

(12) United States Patent
Abergel

(10) Patent No.: US 7,204,256 B2
(45) Date of Patent: Apr. 17, 2007

(54) PACKAGING DEVICE FOR A PRODUCT INCLUDING A DETACHABLE APPLICATOR

(75) Inventor: Aline Abergel, Boulogne (FR)

(73) Assignee: L'Oreal, Paris (FR)

( * ) Notice: Subject to any disclaimer, the term of this patent is extended or adjusted under 35 U.S.C. 154(b) by 395 days.

(21) Appl. No.: 10/698,414

(22) Filed: Nov. 3, 2003

(65) Prior Publication Data

US 2004/0139979 A1 Jul. 22, 2004

Related U.S. Application Data

(60) Provisional application No. 60/428,707, filed on Nov. 25, 2002, provisional application No. 60/428,701, filed on Nov. 25, 2002.

(30) Foreign Application Priority Data

Nov. 4, 2002 (FR) ..... 02 13756
Nov. 4, 2002 (FR) ..... 02 13757

(51) Int. Cl.
*A45D 33/00* (2006.01)
*A45D 33/24* (2006.01)
*B65D 81/02* (2006.01)

(52) U.S. Cl. ..... 132/293; 132/294; 206/581

(58) Field of Classification Search ..... 132/293–297, 132/317, 318, 320; 206/541, 542, 820, 823, 206/581; 2/160, 53; 229/92.8
See application file for complete search history.

(56) References Cited

U.S. PATENT DOCUMENTS 2,061,139 A 11/1936 Cohen
3,796,306 A * 3/1974 Swezey ..... 206/462
4,167,230 A * 9/1979 Barratt ..... 206/380
4,786,534 A 11/1988 Aiken
5,109,979 A * 5/1992 Cole ..... 206/229
5,161,688 A 11/1992 Muchin
5,713,381 A * 2/1998 Sloane ..... 132/312
6,103,040 A * 8/2000 Hunkeler ..... 156/226
6,957,958 B2 * 10/2005 Rowe et al. ..... 433/89

FOREIGN PATENT DOCUMENTS

| | | |
|---|---|---|
| EP | 0722676 | 7/1996 |
| FR | 2740013 | 4/1997 |
| FR | 2806709 | 9/2001 |
| FR | 2821061 | 8/2002 |

* cited by examiner

*Primary Examiner*—John J. Wilson
*Assistant Examiner*—Robyn Doan
(74) *Attorney, Agent, or Firm*—Oblon, Spivak, McClelland, Maier & Neustadt, P.C.

(57) ABSTRACT

A packaging device for a product, preferably a make-up product, including a support generally planar in shape and in the form of a plate having two faces. The support includes at least one cavity having a depth less than or equal to the thickness of the plate, with the cavity opening on at least one face of the support at a first aperture, and with the cavity containing the product. The device includes an applicator for the product which is connected to the support by a junction area that can be broken to detach the applicator from the support. In addition, or alternatively, an adhesive sheet can be attached to the support, with a portion of the sheet forming a housing for the applicator.

58 Claims, 4 Drawing Sheets

20
40
41
22
80
92
II
l
e
L
21
23
81
91
90
910
II 210
40
21
41
22
90
20
10
23

20
40
41
22
80
93
910
91
21
23
82
90

Fig. 6
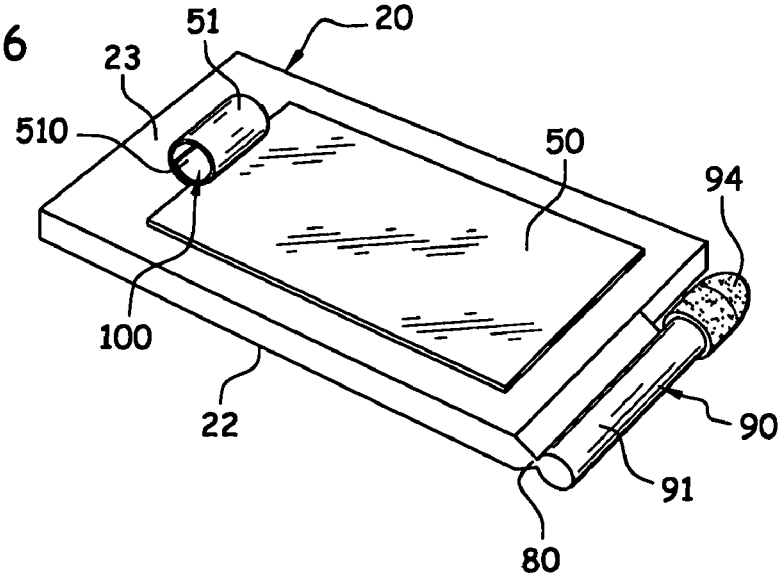
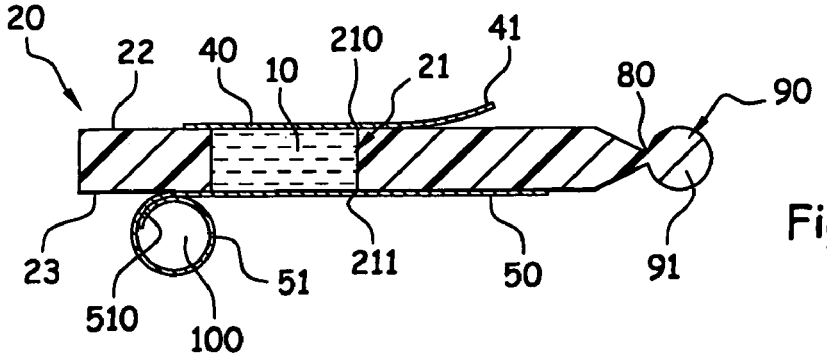
Fig. 7
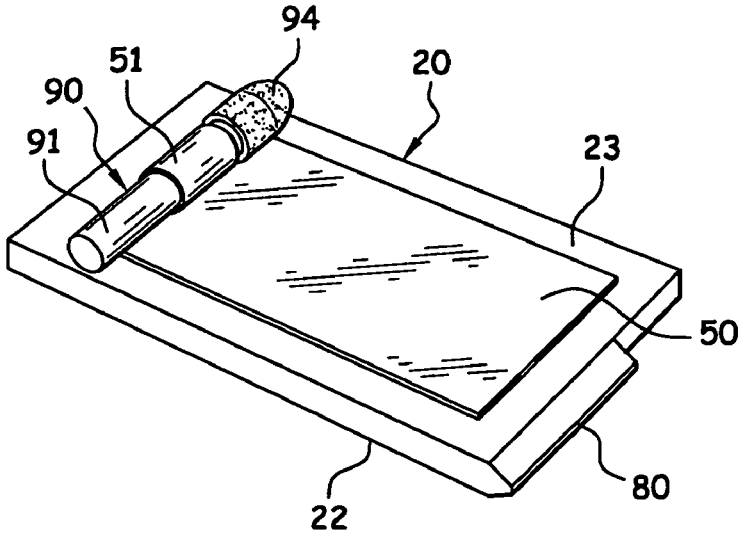
Fig. 8

PACKAGING DEVICE FOR A PRODUCT INCLUDING A DETACHABLE APPLICATOR

CROSS-REFERENCE TO RELATED APPLICATIONS

This document claims priority to French Application Numbers. 02 13756, filed Nov. 4, 2002, and 02 13757, filed Nov. 4, 2002 and U.S. Provisional Application No. 60/428,701, filed Nov. 25, 2002, and 60/428,707, filed Nov. 25, 2002, the entire content of which is hereby incorporated by reference.

FIELD OF THE INVENTION

The present invention relates to a packaging device for a product. The invention is preferable for packaging a solid cosmetic product, and particularly preferable for packaging such products in the form of a sample.

BACKGROUND OF THE INVENTION

Discussion of Background

It is common to distribute samples of cosmetic products in magazines, for example in conjunction with an advertisement page. Tubes or bottles of reduced dimensions are particularly used to package the cosmetic products in sample form. However, such packages are difficult to distribute in magazines for advertising purposes by reason of their size. Other types of packages, for example, sachets containing liquid or cream products, or wipes impregnated with liquid products, can be more readily inserted into magazines. Nevertheless, sachets are difficult to pack with solid products, such as compacted powders for example.

Documents FR 2,740,013, U.S. Pat. No. 2,061,139, FR 2,821,061 and U.S. Pat. No. 5,161,688 describe packages for a sample of a solid or paste-form cosmetic product which can be inserted into a publication. The packages are composed of a plate which includes a central cavity in which the product is contained, with the product disposed either in a cup or directly in the cavity. However, none of these documents describes packages equipped with an applicator. It can be useful to supply an applicator with the product sample to enable the user to apply the product.

Patent application WO88/07825 describes a packaging arrangement that includes an applicator. In particular, the packaging includes two "credit card" type plates arranged to pivot relative to each other, one of which is traversed by several cavities containing a cosmetic product. This plate also contains a housing having an elongated slot which is designed to receive an applicator. The applicator is seated inside the slot into which it is force fitted. It is then necessary to provide means for retaining the applicator inside the plate. In addition, it is relatively difficult to use a plate of limited thickness because the applicator increases the overall thickness of the packaging when seated in the slot. In addition, the applicator must be made separately from the rest of the plate and then inserted into the slot, which complicates the stages of the manufacturing process and requires a separate feed for the applicators. It is preferable in the case of sample type packagings to limit the number of stages in fabrication of the packaging so as to minimize the cost of manufacture.

SUMMARY OF THE INVENTION

One of the objectives of the invention is to provide a packaging device for a product, particularly a cosmetic, which does not have the disadvantages of the prior art.

Another object of the invention is to provide a device which is of small size while retaining the features of a make-up compact, for example.

A further object of the invention is to provide a device that can be made simply and inexpensively.

According to the invention, one or more of the above objects can be achieved by making a packaging device for a product, such as a make-up, having a support generally planar in shape in the form of a plate having two faces. The support has at least one cavity containing a product. The depth of the cavity is less than or equal to the thickness of the plate, with the cavity emerging on at least one of the faces of the support via a first aperture. The device further includes an applicator for the product. The applicator is connected to the support by a junction area that can be broken to detach the applicator from the support.

Thus, the device containing a cosmetic product is associated with an applicator, and the user is not obliged to use her fingers to apply the make-up, or to provide a separate applicator. In addition, because the applicator is integral with the support, the risk of losing the applicator is reduced as it can be difficult for it to become separated from the support without the user deliberately doing so. Further, the applicator can be made with the support in one piece, for example, by molding or by cutting, so that the manufacturing process is relatively simple. This avoids the need for a manufacturing or assembly step in which the applicator is placed or inserted into the support, as is required in the packaging described in patent application WO88/07825. It is thus possible to produce an inexpensive device.

The applicator may be formed as an extension to the support and have, for example, a thickness less than or equal to that of the support. The thickness of the device is thus minimized so that it can be inserted into a magazine for example.

The applicator can include a handling portion having an elongated shape and at least one applicator portion formed at the extremity of the handling portion. Optionally, two applicator portions can also be provided on the applicator, with each being formed at one extremity of the handling portion. The applicator portion is, for example, composed of a foam, a woven or non-woven material, a flock material, or bristles. The applicator portion can be, for example, glued onto the applicator. It could also be provided on a slotted end of the applicator. By way of example, in accordance with one form, the handling portion can be flat in shape and include two faces, and the applicator portion can be in the form of a pad attached for example to one face or to both faces.

The junction area can be composed of an area having a thickness smaller than that of the support. The junction area can extend in a continuous manner along the applicator, or alternatively, the junction area can be composed of several tabs spaced along the applicator, with the tabs preferably either being the same thickness as the support or having a smaller thickness.

According to a feature of one embodiment, the cavity can also emerge or extend to the second face of the support, with an adhesive sheet affixed to that face so as to close off the second aperture to form the bottom of the cavity.

The adhesive sheet can be glued in a manner such that it defines, at least partially, a housing designed to receive an applicator. The adhesive sheet forming the bottom of the cavity is used to delineate a housing capable of receiving an applicator. The number of constituent elements in the packaging is thus reduced, thereby reducing the number of manufacturing steps for the device, and resulting in a device capable of performing the same functions as a conventional compact. An inexpensive packaging device is thus obtained.

According to a first embodiment, the housing can be delineated by an end portion of the sheet which is rolled back onto itself so as to form a housing. The rolled-back end portion has an edge which can be glued to the sheet, and the rest of the portion need not be coated with glue.

According to another embodiment, the housing can be partially delineated by a portion of the sheet which is not glued to the support, and partially by an area of the support located opposite the non-glued portion of the sheet. The area of the support partially delineating the housing can be a portion of a face of the support or alternatively the edge face of the support.

The adhesive sheet can be formed by one or more layers of a material selected from thermoplastic materials, in particular polyolefins or polyesters, and aluminum. The adhesive sheet can also include printed matter, for example, with an inscription relating to the product, or a decorative pattern.

The device may include a lid, generally planar in shape, and hinged on the support. The adhesive sheet can be partially glued to a face of the lid so as to form a hinge between the support and the lid.

The device can also include a label forming a mirror glued to one of the faces of the lid. This label can also be glued in part to one of the faces of the support so as to form the hinge between the support and the lid.

The device could also include a detachable seal closing the first aperture in a detachable manner, with the seal being subject to removal prior to the first use in order to access the product.

According to another aspect, the invention relates to a packaging device for a product, with the device particularly advantageous for make-up, and including a support generally planar in shape and having two faces. The support is traversed by at least one cavity emerging or extending to each face of the support via a first aperture or opening and a second aperture or opening. The cavity contains the product. An adhesive sheet is glued, at least partially, to a face of the support so as to close off the second aperture.

With this arrangement of the invention, the sheet is glued in a manner such that it delineates, at least partially, a housing designed to receive an applicator.

BRIEF DESCRIPTION OF THE DRAWINGS

Other characteristics and advantages of the invention will become apparent from the following detailed description, particularly when considered in conjunction with the drawings in which:

FIGS. 6 to 8 illustrate a fourth embodiment of the device according to the invention;

DETAILED DESCRIPTION OF THE PREFERRED EMBODIMENTS

Figure 1:
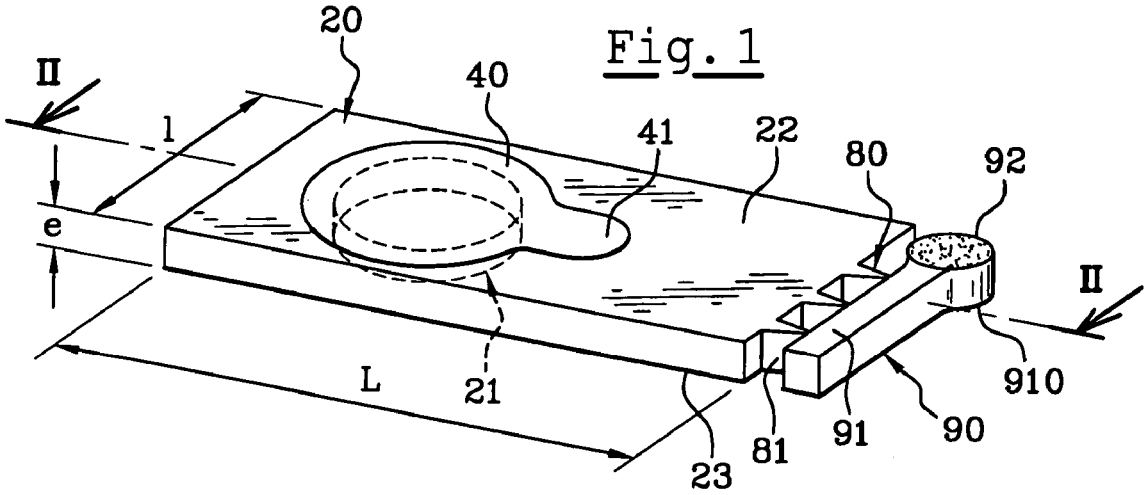
FIG. 1 is a perspective view of a first embodiment of a device according to the invention.
Figure 2:
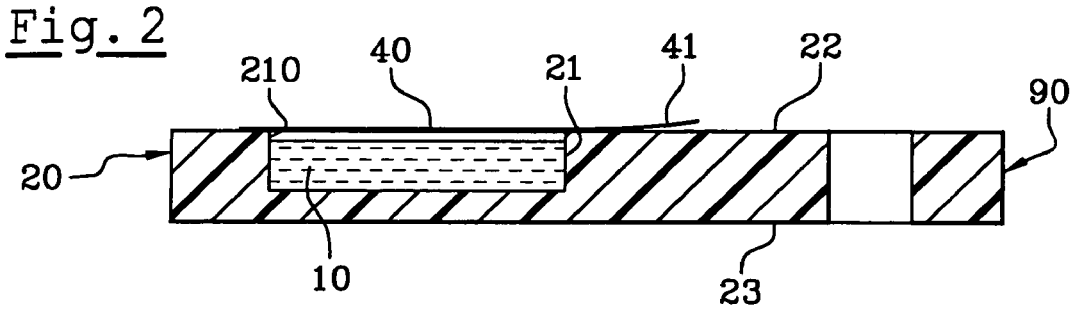
FIG. 2 is a cross-section of the device of FIG. 1.

The device according to the invention shown in FIGS. 1 and 2 includes a rectangular support 20, for example, having a "credit card" type format, which incorporates within its thickness a cavity 21 designed to receive the product 10. Obviously the support can have any other shape; it may for example be square, round, oval, etc.

The support 20 has two planar and parallel faces 22 and 23 of length L and width 1. The cavity 21 emerges on one of the faces 22 of the support 20 via an aperture 210. The support 20 is of limited thickness e on the order of a millimeter. For example, the support can be between 0.5 and 2 mm. According to one example, the support can have a thickness of 0.8 mm. The cavity 21 is of circular cross-section but it can also be of square, rectangular, oval cross-section or any other shape. The cavity is designed to receive a small quantity of product, for example 0.15 g.

A detachable seal or cover 40 is attached to the face 22 of the support so as to close off the aperture 210 of the cavity by which the user can gain access to the product. This cover can include, for example, a glazed polyester type label which is glued to the upper face of the support.

A transparent label will preferably be selected so as to allow the user to see the product present in the packaging. The label can be coated with a semi-permanent adhesive enabling it to be held correctly in contact with the face so as to close off the aperture while being readily removable from the face. Advantageously, an adhesive will be selected which allows the label to be re-sealed on the support at least once after a first opening. The detachable seal of the illustrated embodiment preferably includes a handling portion 41 located at the periphery of the label so as to form a tongue which can be readily grasped by the user to remove the label from the support.

An applicator 90 is formed as an extension to the support 20, along its width 1, to which it is connected by a junction area 80. The applicator extends, for example, over the full width 1 of the support. The applicator 90 preferably has a small thickness, e.g., identical to that of the support, and can include two planar faces each formed respectively in the same plane as the two faces 22 and 23 of the support. The applicator includes a relatively elongated handling portion 91 of limited width allowing it to be readily grasped by the user and easily manipulated during application of the product. An applicator portion 92 is formed at one extremity 910 of the handling portion, which is circular in shape for example. The illustrated applicator portion is composed of a foam pad glued to a face of the extremity 910 of the handling portion. It would of course be possible to provide a second foam pad glued to the second face of the extremity 910. Further, as noted earlier, other types of applicator portions could be used instead of the foam pad type.

The junction area 80 is intended to be broken so as to detach the applicator from the support in an irreversible manner. It is formed by tabs 81, for example, with three tabs provided in the illustrated embodiment, and with the illustrated tabs having the same thickness e as the support and the applicator. In the example illustrated, the tabs 81 are triangular in shape, with their base being connected to the support and their apex to the applicator. The length of the tabs, measured along the length L of the support, is relatively short, for example approximately 2 mm, so as to produce a relatively compact assembly. In addition, they are spaced along the handling portion so as to correctly hold the applicator attached to the support. The tabs 81 have a relatively small width, measured at their base along the width 1 of the support, for example approximately 2 mm, so that they can be easily broken when the user bends them about an axis parallel to the width of the support.

The entire device is, for example, obtained by molding a thermoplastic material as a single piece, with the foam pad being glued on after the unit is formed. Alternatively, the device can be made by cutting a plate from a thermoplastic material. The thermoplastic material may, for example, be a polyvinyl chloride (PVC), a polypropylene or a polyethylene terephthalate (PET).

Figure 3:
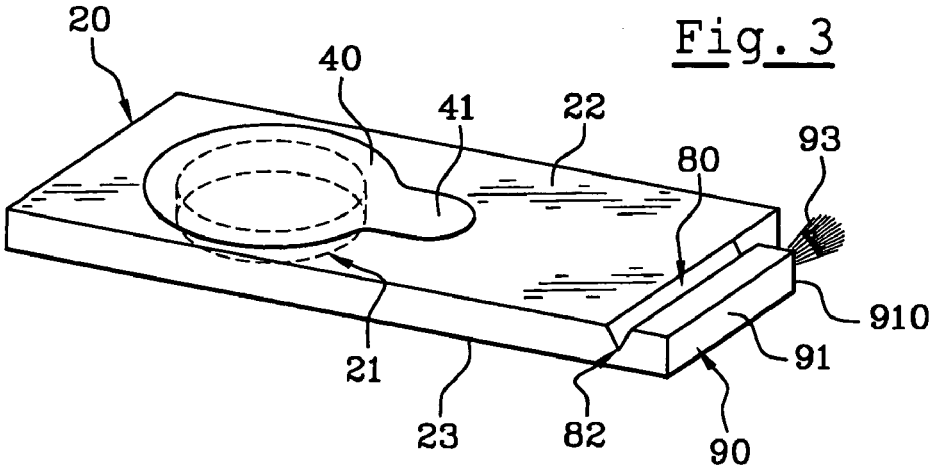
FIG. 3 is a perspective view of a second embodiment of a device according to the invention.

The device illustrated in FIG. 3 differs from that just described in that the junction area 80 is formed in this instance by a portion 82 having a thickness smaller than the thickness e of the support. The portion 82 has, for example, a thickness of approximately 0.5 mm. This portion 82 extends in a continuous manner along the full length of the handling portion 91 of the applicator. In addition, the applicator portion is in this instance formed by a tuft of bristles 93 glued to the extremity 910 of the handling portion.

In order to use the devices of the embodiments described above, the user grasps the applicator 90 and pivots it about an axis parallel to the width of the support so as to break the junction area 80. She can then take up the product with the applicator portion 92 or 93, after removing the seal 40. She then applies the product thus taken up to a part of her face as desired.

Figure 4:
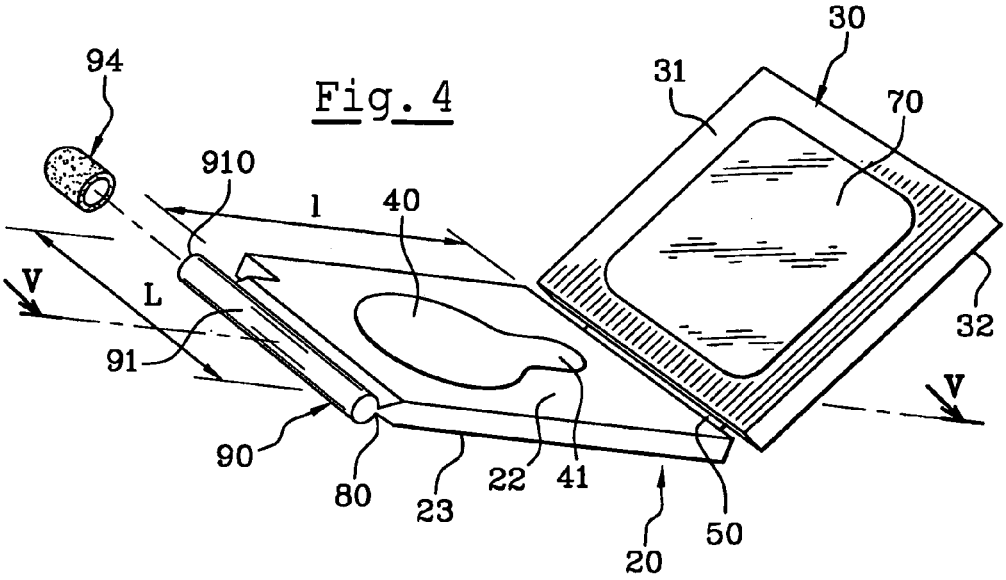
FIG. 4 is a perspective view of a third embodiment of the device according to the invention.
Figure 5:
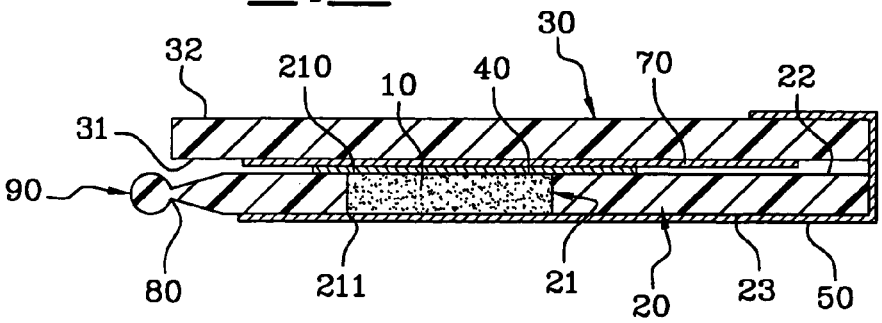
FIG. 5 shows a cross-section of the device in FIG. 4.

The device shown in FIGS. 4 and 5 includes a support identical to that just described except that the cavity 21 emerges or extends to each face 22 and 23 via two apertures 210 and 211 respectively. An adhesive film 50 is glued to the face 23 so as to close off the second aperture 211 of the cavity 21. This adhesive film has a greater bonding capacity than the detachable seal 40 as it is not intended to be removed from the support. It thus constitutes the bottom of the packaging. The side of the adhesive film 50 opposite the adhesive face can include printed matter, in particular a decorative pattern or an inscription relating to the product contained in the cavity.

In the arrangement of FIGS. 4 and 5, the device additionally includes a lid 30, also rectangular and having two parallel planar faces 31 and 32, a first face 31 being intended to rest on the face 22 of the support. The lid 30 also preferably has a limited thickness, on the order of approximately 0.8 mm for example. The face 31 may be covered with a mirror label 70. The lid 30 is articulated on the support 20 by means of the adhesive film 50 which partially covers the face 32 of the lid onto which it is glued so that it constitutes a hinge between the support 20 and the lid 30.

The applicator 90 is formed as an extension to the support 20, but in this instance along its length L. In addition, the handling portion 91 in this instance is formed by a rod of circular cross-section and the applicator portion has the form of a sleeve 94. This sleeve is fitted over the extremity 910 of the handling portion to which it is glued. The sleeve is for example made as a layer of flocked foam. The junction area 80 is similar to that of the device in FIG. 3, i.e., formed as an area of lesser thickness than that of the support and of the applicator. To make the device, the lid 30 may be fabricated together with the support and the applicator in a single piece, for example by molding a thermoplastic material, with the support and lid being separated by a groove. The first aperture 210 is then closed off in a detachable manner by means of the detachable seal or cover 40 which is glued to the face 22 of the support 20 and the mirror label 70 is glued to the face 31 of the lid. The cosmetic product 10 is then introduced in powder form, via the second aperture 211, into the cavity 21 and then compacted so as to form a tablet of product. According to a variant, a semi-liquid or viscous product can be poured into the cavity. The second aperture 211 is closed off by the adhesive film 50 by pressing it onto the face 22 of the support so as to form the bottom of the packaging. As the adhesive film 50 is being glued or adhered to the face 32 of the lid, the plate is folded along the groove so as to detach the support 20 and the lid 30 which are immediately re-attached by the adhesive film 50.

The device shown in FIGS. 6 to 8 differs from that in FIG. 4 in that it does not include a lid and in that the adhesive film 50 includes an end portion 51 which is rolled back on itself to form a tubular housing 100. This end portion is preferably narrower in width than the rest of the film. It must be sufficiently wide to be able to correctly hold the applicator which it is intended to receive. In addition, this portion is partially free of adhesive and only includes an edge 510 coated in adhesive which is glued to the back of the adhesive film to secure the housing 100.

To use the device, the user must break the junction area 80 to detach the applicator from the support and remove the seal 40 so as to be able to take up the product by means of the applicator portion 94. She can then apply the product, for example to her face. After use, the applicator can be placed in the tubular housing 100, as shown in FIG. 8.

Figure 9:
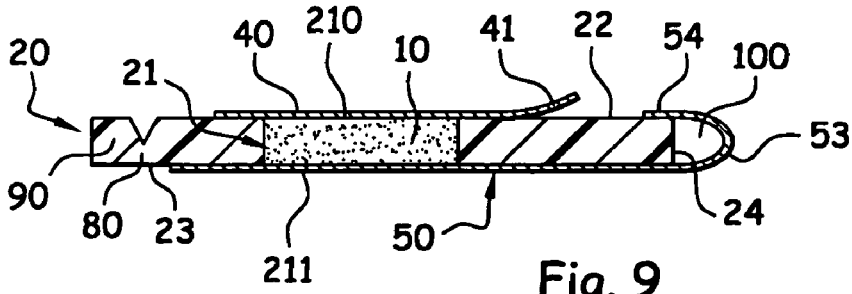
FIG. 9 illustrates a fifth embodiment of the device according to the invention.

The device illustrated in FIG. 9 differs from that illustrated in FIGS. 6 to 8 in that the end portion 51 of the rolled sheet forming the housing is replaced by a portion 53 which is not glued to the support and which forms the housing 100 in conjunction with the end face 24 of the support. This portion 53 can be made free of adhesive. In addition, the sheet 50 extends beyond the portion 53 by an end portion 54 which is glued to the face 22 of the support. According to this embodiment, the housing 100 does not increase the overall thickness of the packaging.

Figure 10:
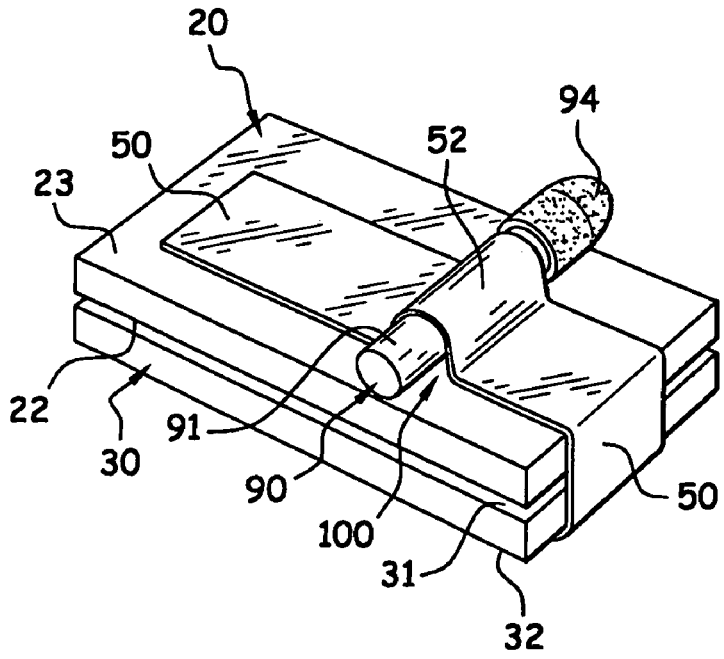
FIGS. 10 and 11 illustrate a fifth embodiment of the device according to the invention.
Figure 11:
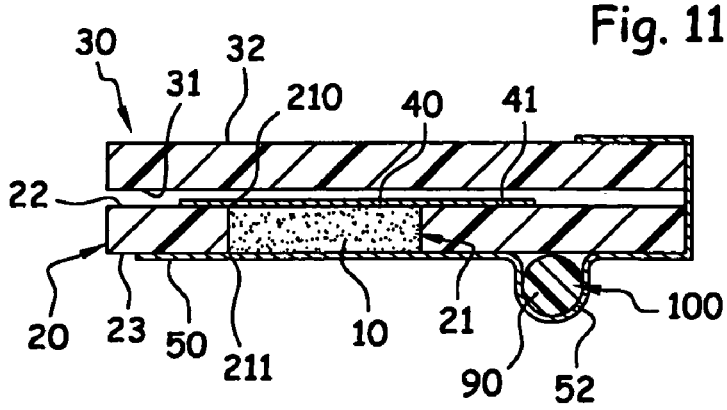

The device illustrated in FIGS. 10 and 11 includes a support 20 substantially identical to that described in accordance with FIGS. 6 to 8. The support includes a cavity 21 emerging or extending to each face 22 and 23 of the support via apertures 210 and 211 respectively. A detachable seal 40 closes off a first aperture 210, preferably in a reversible manner, and an adhesive film 50 closes off the second aperture 211. However, according to this embodiment, the housing 100 is delineated by a portion 52 of the adhesive film 50 which is not glued to the face 23 of the support and which is located between two portions glued to the face 23. It thus forms a half-cylinder or partial cylinder which delineates, in conjunction with an opposing portion of the face 23, a housing 100 for an applicator. Preferably, the portion 52 is not coated with adhesive.

According to the embodiment of FIGS. 10 and 11, the support does not include an applicator that is irreversibly detachable by breaking a junction area. An applicator 90 is fitted directly in the housing 100. However, it is to be understood that an arrangement as shown in FIGS. 10 and 11 could also be provided with an applicator integral with the support as in the first embodiment, with the applicator stored in a housing as shown at 100 after detachment of the applicator.

In the arrangement of FIGS. 10 and 11, the device additionally includes a lid 30, also rectangular, and having two parallel planar faces 31 and 32, a first face 31 being intended to rest on the face 22 of the support. The lid 30 also has a limited thickness, on the order of approximately 0.8 mm. for example. The lid 30 is articulated on the support 20 by means of the adhesive film 50 which extends so as to partially cover the face 32 of the lid to which it is glued so that it constitutes a hinge between the support 20 and the lid 30.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A packaging device for a product comprising:

a support having a generally planar shape in the form of a plate having two faces, said two faces including planar surfaces such that said support is in the form of a flat plate, wherein said support is traversed by at least one cavity, wherein the depth of the cavity is less than or equal to a thickness of the plate extending between said two faces, said cavity opening on at least one face of said two faces of the support at a first aperture, wherein said cavity contains a product;

the device further including an applicator for the product, wherein said applicator is connected to the support by a junction area which is breakable so as to detach the applicator from the support.

2. A device according to claim 1, wherein the applicator is formed as an extension of the support and has a thickness less than or equal to that of the support.

3. A device according to claim 2, wherein the applicator includes an elongated handling portion and at least one applicator portion formed at an end of the handling portion.

4. A device according to claim 3, wherein the applicator portion includes at least one of a foam material, a woven material, a non-woven material, a flock material, and bristles.

5. A device according to claim 1, wherein the junction area includes an area having a thickness smaller than that of the support.

6. A device according to claim 5, wherein the junction area extends continuously along the applicator.

7. A device according to claim 5, wherein the junction area includes a plurality of tabs spaced along the applicator.

8. A device according to claim 1, wherein the junction area extends continuously along the applicator.

9. A device according to claim 1, wherein the junction area includes a plurality of tabs spaced along the applicator.

10. A device according to claim 1, wherein the cavity extends through said support and opens on both of said two faces of said support, and wherein said cavity opens at a second aperture on a face opposite to the face having said first aperture, and wherein an adhesive sheet closes off the second aperture and forms a bottom of the cavity.

11. A device according to claim 10, wherein the adhesive sheet at least partially delineates a housing designed to receive the applicator.

12. A device according to claim 11, wherein the housing is delineated by a rolled-back end portion of the sheet which is rolled back on itself to form a tubular housing.

13. A device according to claim 12, wherein the rolled-back portion has an edge glued to the sheet, the rest of the rolled-back portion not being coated with glue.

14. A device according to claim 11, wherein the housing is partially delineated by a portion of the sheet which is not glued to the support, and partially by an area of the support located opposite the portion of the sheet.

15. A device according to claim 14, wherein the area of the support which partially delineates the housing is an area of one of the faces of the support.

16. A device according to claim 14, wherein the area of the support which partially delineates the housing is an area of an end surface of the support.

17. A device according to claim 11, wherein the device further includes a lid generally planar in shape and having two faces, and wherein the lid is articulated to the support.

18. A device according to claim 17, wherein the adhesive sheet is partially glued to a face of the lid so as to form the articulation between the support and the lid.

19. A device according to claim 18, further including a label forming a mirror glued to one of the faces of the lid.

20. A device according to claim 10, wherein the device further includes a lid generally planar in shape and having two faces, and wherein the lid is articulated to the support.

21. A device according to claim 20, wherein the adhesive sheet is partially glued to a face of the lid so as to form the articulation between the support and the lid.

22. A packaging device according to claim 20, wherein said two faces of said lid are parallel to said two faces of said support in a closed position of said lid, and wherein the device further includes a seal which closes said first aperture and which is located between said lid and said support when said lid is in the closed position.

23. A device according to claim 1, wherein the device further includes a lid generally planar in shape and having two faces, and wherein the lid is articulated to the support.

24. A device according to claim 23, further including a label forming a mirror glued to one of the faces of the lid.

25. A device according to claim 24, wherein the label forming a mirror is partially glued to one of the faces of the support so as to form the articulation between the support and the lid.

26. A device according to claim 1, further including a detachable seal closing off the first aperture in a detachable manner, said seal being removed before use in order to access the product.

27. A device according to claim 1, wherein said cavity contains a make-up product.

28. A device according to claim 1, wherein said device holds a make-up sample.

29. A packaging device according to claim 1, wherein said support includes at least one side face extending between said two faces, wherein said applicator is connected to said at least one side face and wherein said applicator extends along a direction parallel to said two faces prior to breaking of said breakable junction.

30. A packaging device according to claim 29, wherein said applicator includes a handle portion having a thickness which is the same as the thickness of the plate.

31. A packaging device according to claim 29, wherein said support includes a plurality of side faces and said applicator is connected to one of said side faces.

32. A packaging device for a product, including:

a support generally planar in shape and having two faces, the support being traversed by at least one cavity which opens on each face of the support via a first aperture and a second aperture, and wherein the cavity contains a product; and an adhesive sheet at least partially adhered to a face of the support so as to close off the second aperture, and wherein the sheet is glued in a manner such that it delineates, at least partially, a housing designed to receive an applicator.

33. A packaging device as recited in claim 32, wherein the applicator is held against said support by said adhesive sheet.

34. A packaging device as recited in claim 33, wherein said applicator is held adjacent the face of said support having said second aperture at a location spaced from said second aperture.

35. A packaging device as recited in claim 33, wherein the applicator is held adjacent a side surface of said support which extends between said two faces.

36. A packaging device as recited in claim 32, further including an applicator which is housed in said housing before a first use.

37. A packaging device as recited in claim 32, further including an applicator, wherein said applicator is connected to said support by a breakable junction area, and wherein after breaking of said breakable junction area, said applicator can be held in said housing which is at least partially delineated by said adhesive sheet.

38. A packaging device as recited in claim 32, further including a lid, and wherein said adhesive sheet hingedly couples said lid and said support.

39. A packaging device for a product comprising:

a support having a first face and a second face, said support including at least one cavity extending at least partially through said support and opening on said first face at a first aperture, wherein said at least one cavity contains a product;

an applicator for applying the product;

wherein said packaging device further includes:

(i) a breakable junction coupling said applicator to said support, wherein upon breaking of said junction said applicator is detached from said support and is freed for use in applying said product; and (ii) an adhesive sheet at least partially adhered to one of said first and second faces of said support, wherein a portion of said sheet at least partially defines a housing for receiving said applicator and wherein prior to a first use, the applicator is separated from said support by breaking said junction, and thereafter, said applicator can be stored in said housing.

40. A packaging device as recited in claim 39, further including a removable seal which covers said first aperture to cover said product prior to use.

41. A packaging device according to claim 40, wherein said cavity extends through said support and opens on said second face at a second aperture, and wherein said adhesive sheet covers said second aperture to close said second aperture on said second face.

42. A packaging device according to claim 39, wherein said cavity extends through said support and opens on said second face at a second aperture, and wherein said adhesive sheet covers said second aperture to close said second aperture on said second face.

43. A packaging device according to claim 39, wherein said product is a make-up product.

44. A packaging device according to claim 39, wherein said product is a make-up product.

45. A packaging device according to claim 39, wherein said packaging device includes said adhesive sheet, and wherein said cavity extends through said support and opens on said second face at a second aperture, and further wherein said adhesive sheet covers said second aperture to close said second aperture.

46. A packaging device according to claim 45, wherein said housing is disposed on an edge face of said support.

47. A packaging device according to claim 45, wherein said housing is disposed on one of said first and second faces of said support.

48. A packaging device according to claim 39, wherein said first and second faces of said support are flat.

49. A packaging device according to claim 39, wherein said packaging device includes said breakable junction.

50. A packaging device according to claim 49, wherein said breakable junction extends continuously along an edge of said support.

51. A packaging device according to claim 49, wherein said breakable junction includes a plurality of spaced tabs extending between said support and said applicator.

52. A packaging device according to claim 49, wherein said first and second faces of said support are flat, and wherein said applicator includes two flat faces.

53. A packaging device according to claim 49, further including a removable seal that removably closes said first aperture.

54. A packaging device according to claim 53, further including a lid, wherein said lid covers said removable seal in a closed position, and further wherein said lid is articulated to said support by an adhesive sheet.

55. A packaging device according to claim 53, wherein said product is a make-up product.

56. A packaging device for a product comprising:

a support having a first face and a second face, said support including at least one cavity extending through said support, said cavity opening on said first face at a first aperture and on said second face at a second aperture, wherein said at least one cavity contains a product;

an applicator for applying the product;

wherein said packaging device further includes an adhesive sheet at least partially adhered to one of said first and second faces of said support, wherein a portion of said sheet at least partially defines a housing for receiving said applicator, and wherein said adhesive sheet covers said second aperture to close said second aperture; and the device further including a lid, and wherein said adhesive sheet is attached to a portion of said lid such that said lid is articulated to said support by way of said adhesive sheet.

57. A packaging device according to claim 56, wherein in a closed position said lid at least partially covers said first face of said support and extends over said first aperture.

58. A packaging device according to claim 57, further including a removable seal that extends over said first aperture to removably close said first aperture, and wherein in said closed position said lid covers said removable seal.

* * * * *

UNITED STATES PATENT AND TRADEMARK OFFICE

CERTIFICATE OF CORRECTION

PATENT NO. : 7,204,256 B2
APPLICATION NO. : 10/698414
DATED : April 17, 2007
INVENTOR(S) : Aline Abergel It is certified that error appears in the above-identified patent and that said Letters Patent is hereby corrected as shown below:

Column 7, line 45, change “5” to --1--.

line 47, change “1” to --5--.

line 48, after “area” delete “extends continuously along the applicator” and insert --includes a plurality of tabs spaced along the applicator--.

Signed and Sealed this

Sixth Day of November, 2007

JON W. DUDAS
*Director of the United States Patent and Trademark Office*